United States Patent [19]

De Kermadec et al.

[11] Patent Number: 4,771,698

[45] Date of Patent: Sep. 20, 1988

[54] SENSING SYSTEM FOR A TRACKED VEHICLE TRANSPORTATION SYSTEM

[75] Inventors: Jean H. De Kermadec, Le Chesnay; Guy M. C. M. Thomas, Bagneres De Bigorre, both of France

[73] Assignee: Soule, Bagneres de Bigorre, France

[21] Appl. No.: 933,929

[22] Filed: Nov. 24, 1986

[30] Foreign Application Priority Data

Nov. 27, 1985 [FR] France ..... 85 17510

[51] Int. Cl.[4] ..... B61B 1/02

[52] U.S. Cl. ..... 104/30; 246/120; 238/6

[58] Field of Search ..... 200/85 A, 85 R, 86 A, 200/86.5, 153 C; 177/45, 46; 74/108, 110; 340/556; 238/1, 6, 379, 380; 246/1 C, 27, 30, 120, 121; 116/98; 104/27, 30

[56] References Cited

U.S. PATENT DOCUMENTS

| | | | |
|---|---|---|---|
| 340,425 | 4/1886 | Cox | 200/85 R |
| 448,051 | 3/1891 | Kierson et al. | 116/98 |
| 497,062 | 5/1893 | Sturtevant | 200/85 R |
| 529,252 | 11/1894 | Evans | 74/108 |
| 767,140 | 8/1904 | Ferher | 200/85 R |
| 1,877,279 | 5/1930 | Dawson | 340/556 X |
| 2,569,111 | 9/1951 | Miller | 246/120 |
| 3,273,861 | 9/1966 | Schuff | 74/110 |
| 4,413,568 | 11/1983 | Huon De Kermadec | 104/20 |
| 4,512,259 | 4/1985 | Huon De Kermadec | 104/208 |

FOREIGN PATENT DOCUMENTS

| | | | |
|---|---|---|---|
| 2423730 | 11/1975 | Fed. Rep. of Germany | 74/108 |
| 1442942 | 5/1966 | France . | |
| 2235359 | 1/1975 | France . | |
| 516673 | 1/1940 | United Kingdom . | |
| 529511 | 11/1940 | United Kingdom . | |
| 869668 | 6/1961 | United Kingdom | 116/98 |

*Primary Examiner*—Robert B. Reeves
*Assistant Examiner*—Frank H. Williams, Jr.
*Attorney, Agent, or Firm*—Perry Carvellas

[57] ABSTRACT

A sensing system for use on a tracked vehicle transporation system forms a sensitive floor beneath the lip of a platform. The floor is made up of a plurality of metal plates mounted on spring supports so that they can be slightly depressed if an abnormal load is applied to them. Such depression changes the state of a switch or like means through the intermediary of a cable and a lever.

12 Claims, 2 Drawing Sheets

SENSING SYSTEM FOR A TRACKED VEHICLE TRANSPORTATION SYSTEM

BACKGROUND OF THE INVENTION

1. Field of the Invention

The invention concerns a sensing system for use on a track of a tracked vehicle transportation system, such as a railroad track, for example, adapted to trip alarm means and optionally to stop temporarily a vehicle travelling on the track.

2. Description of the Prior Art

Public transport systems, especially of the kind comprising cars travelling on railroad type tracks, have become increasingly automated in recent years, one consequence of which is a reduction in the number of surveillance personnel on the platform.

As a result, surveillance of the stations is practised from a central office using a closed circuit television system. The operating personnel in the surveillance office may therefore have to monitor a large number of television screens. The presence of a person on the track therefore represents a considerable danger, since even if it is detected quickly at the surveillance office it is not always possible for action to be taken immediately.

An object of the invention is to provide a solution to this type of problem by offering a system adapted to detect without delay the presence of a person on the track and to trip alarm means and optionally a number of automatic safety systems to halt temporarily the circulation of one or more vehicles representing a hazard to the person on the track.

SUMMARY OF THE INVENTION

The invention consists in a sensing system for use on a tracked vehicle transportation system, comprising at least one plate, support means for the at least one plate preferably adapted to hold the at least one plate in a substantially horizontal position and two-state sensing means coupled to the at least one plate, wherein the at least one plate and/or the support means is or are at least partially deformable and the sensing means are adapted to change state in response to displacement and/or deformation of the at least one plate.

The invention is therefore particularly applicable to stations of all kinds (railroad, subway, etc). Another specific area of application of the inventio is transportation systems covering moderate distances (a few hundred meters) in which the cars are driven by a common cable between the stations. A transportation system of this kind is described, for example, in U.S. Pat. Nos. 4,413,568 and 4,512,259. In a system of this kind, designed to operate with virtually no surveillance, the cars are uncoupled from the cable in the station or in each station and taken up by a succession of travelling belts running at different speeds. A sensing system in accordance with the invention has therefore been especially designed for equipping a station of this kind, given that it is a relatively simple matter to condition operation of such travelling belts to the state of the sensing system, so as bring about immediate halting of the car or cars moving slowly through the station in question. Further control means, optionally incorporating a time-delay, may be provided to act on the cable drive means should the problem persist.

In a preferred embodiment the at least one plate is rigid and the system further comprises spring supports for at least part of the at least one plate whereby limited depression of the plate is made possible. Depression of the plate actuates the sensing means. A plurality of like plates may advantageously be provided in side-by-side alignment, beneath the lip of the platform, so as to constitute a kind of "sensitive" floor. A sensing device may be associated with each plate or with two plates if it is placed near adjacent edges of two consecutive plates; instead a single sensing device common to all the plates may be coupled to them by an arrangement responsive to depression and/or deformation of at least one of them. This arrangement may comprise, for example, a light beam (infrared or other—possibly a laser beam) generator facing an appropriate sensor. The generator and the sensor are situated near respective ends of the alignment of plates and the plates carry structural members adapted to cut off the beam when at least one of them is displaced and/or deformed. The generator and the sensor could be placed in face-to-face relationship to each other below the floor defined by the plates, for example, and the plates could comprise fins welded on perpendicularly to their lower surface and arranged to interrupt the beam if the corresponding plate is depressed. As will emerge later, the arrangement responsive to displacement and/or deformation of a plate could instead comprise a cable stretched between the ends of the alignment of plates, under the plates, actuation of the cable by one of the plates operating a switch or any equivalent electromechanical means situated at one end of the alignment of plates. The cable and/or the switch could with advantage be duplicated.

The invention will be better understood and other advantages of the invention will emerge more clearly from the following description of a sensing system in accordance with the invention given by way of example only and with reference to the appended drawings.

DESCRIPTION OF THE PREFERRED EMBODIMENT

Figure 1:
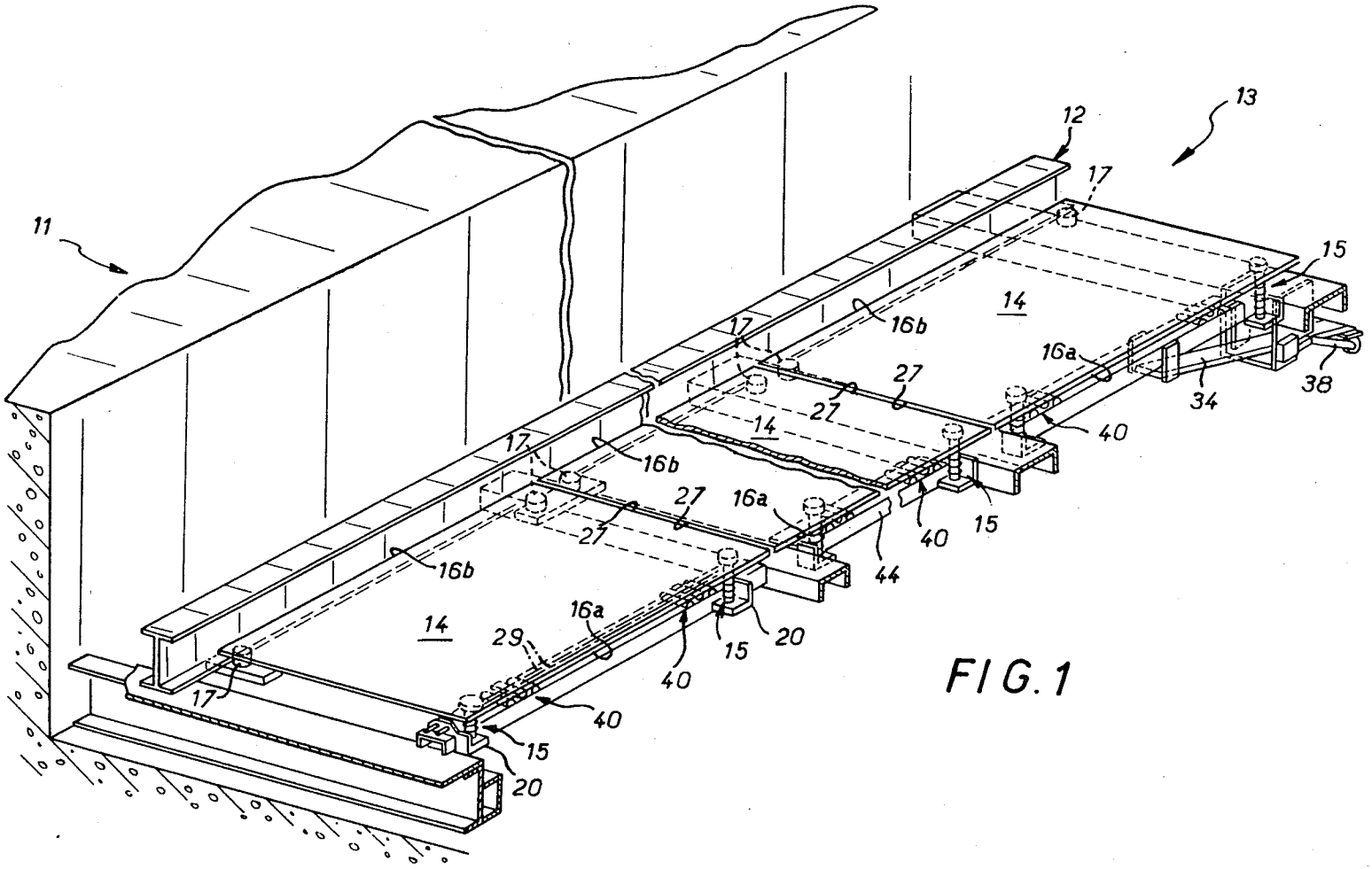
FIG. 1 is a partial view in perspective of a system in accordance with the invention.

The drawings show a platform 11 beneath the lip of which is a vehicle guide track, of the railroad track type, of which only the rail 12 nearest the platform is shown in FIG. 1, to avoid masking the details of the invention. A sensing system 13 is disposed between the two rails and comprises a number of metal plates 14 situated in side-by-side alignment parallel to the platform 11 so as define a kind of floor of sufficient surface area for any heavy person or object present on the track to stand or rest at least temporarily on one of the plates. In the case shown the plates 14 are relatively rigid and mounted on elastically deformable supports to be described later. They could be semi-rigid and deformable and mounted on fixed supports, deformation of them actuating a sensing device. The plates may have a grid structure.

To be more specific, each plate 14 is supported at four points comprising two spring supports 15 disposed in the vicinity of a longitudinal edge **16*a* of the plate and two damper blocks 17 of rubber, an elastomer material or the like disposed in the vicinity of the opposite parallel edge 16*b* of the plate. The blocks 17 are fixed between the plate and a fixed structure (ties of the track, for example), whereas the plate 14 rests under its own weight on the spring supports 15. Thus limited depression of the plate is possible by compressing the spring supports. To this end a spring support 15 comprises a stem 19 movable axially and substantially vertically in a hole formed in a base 20 and the stem ends at the top in a pad on which the plate 14 rests. The rear surface of this pad defines a bearing shoulder 23 for a helical spring 24 disposed around the stem between this shoulder and the base 20. The spring 24 thus holds the stem 19 in a vertical position, the stem being locked into the base 20 by means of a nut 25 fixed to the lower portion of the stem and serving as a shoulder abutting against the base 20. The weight of the plate 14 is thus balanced by the compressed springs 24 in such a way that the position of the plate can vary with an adequate degree of sensitivity immediately when an additional loading is applied to the plate. The system is thus responsive to relatively low weights. The blocks 17 disposed in alignment along the edges 16*b* of the plate (that is to say in the vicinity of the rail 12**) could be replaced by hinges.

As previously mentioned, each plate may be associated with an individual sensing device, for example a switch disposed beneath the plate at a small distance from its lower surface. The contacts of such switches would be connected together in an electrical monitoring circuit (for example, a simple series connection of these contacts). To enhance the reliability of the installation, and to guard against possible failure of any switch, it would nevertheless be preferable to dispose such switches near adjoining transverse edges 27 of adjacent plates 14, using a mechanical coupling system such that the same switch could be operated by either plate. In other words, each plate 14 would thus be adapted to operate at least two switches.

In the example shown the sensing system in the form of a switch 26 (alternatively two switches) is common to all the plates and coupled to them by at least one cable 29 (in this example there are actually two parallel cables for enhanced reliability), extending beneath the plates from one end to the other of the alignment of plates and kept taut.

Figure 2:
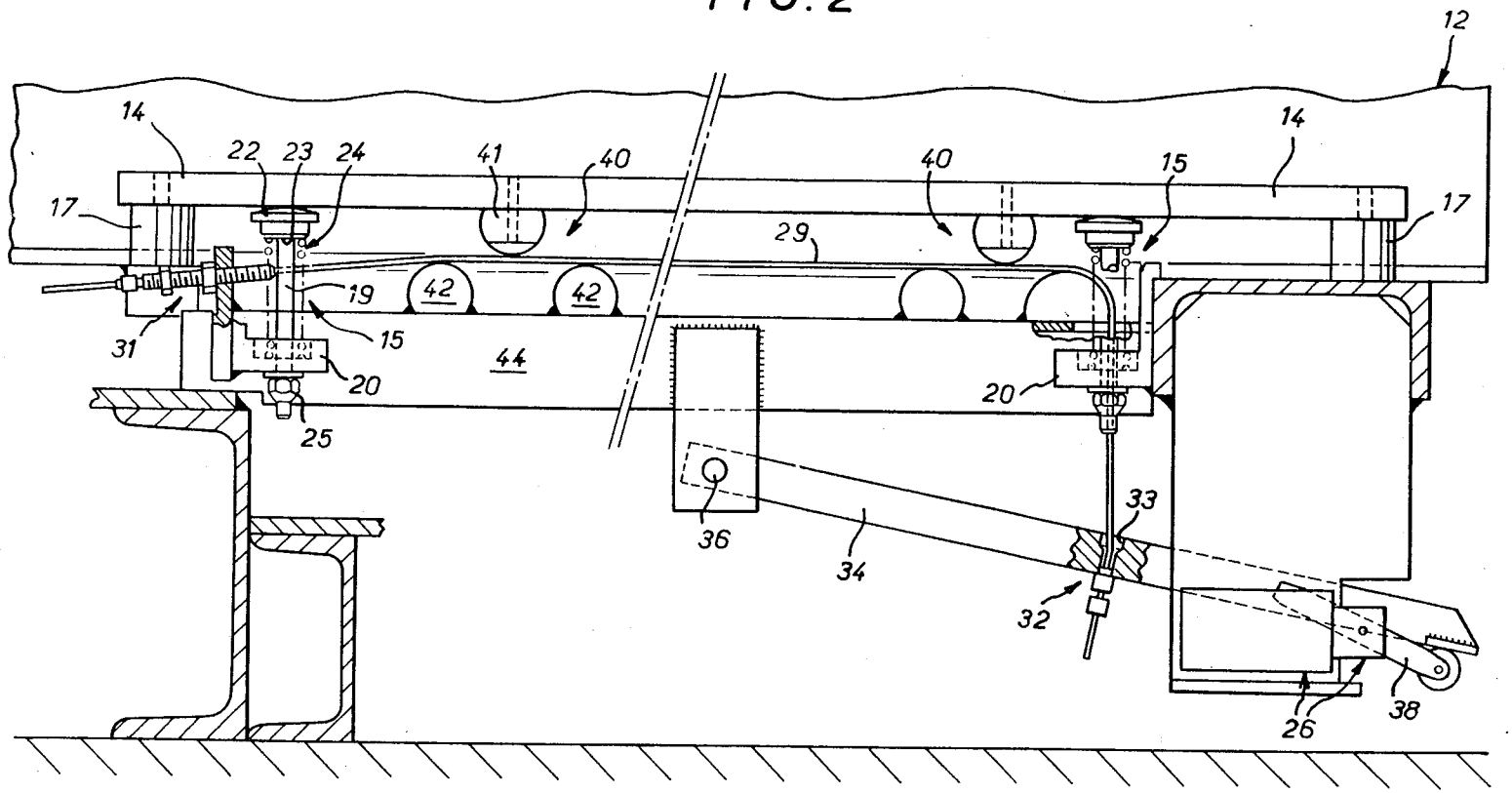
FIG. 2 is a schematic view in elevation and partly in cross-section showing the two longitudinal ends of the alignment of plates from FIG. 1.

FIG. 2 shows that one end 31 of each cable 29 is anchored to a fixed part and the other end 32 is anchored to an intermediate point 33 on a counterweighted lever 34 pivoting about a horizontal pin 36. The weight of the lever 34 keeps the cables 29 taut.

In the normal situation the cables 29 hold the lever 34 in a predetermined position in which they cooperate with an arm 38 of one or two switches 26 to maintain it in a predetermined state, with the contacts closed, for example. The cables 29 pass between two groups 40 of ribs 41, 42 that are offset relative to each other and, within each group, fixed to one of the plates 14 and a bottom fixed support 44. To be more precise, each group 40 comprises one rib 41 fixed to the bottom surface of the plate 14 and two parallel spaced ribs 42 disposed on the support 44 in such a way that the corresponding rib 41 can enter the space between them, drawing the cables 29 with it, when the plate is moved. The ribs 41 and 42 are lengths of substantially cylindrical metal rod respectively attached to the plate 14 and to the support 44. These rods may be machined so as to feature a longitudinal fixing flat. In the example shown, each plate 14 comprises two such groups of ribs.

The system that has just been described functions in an extremely simple manner that is evident from the foregoing description. Should a heavy person or object fall onto one of the plates 14, this tilts slightly by forcing down the spring supports 15, which causes the cables 29 to be deformed between the ribs 41, 42. This action on the cables 29 results in the lever 34 being raised which in turn operates the sensing means consisting here of the switch or switches 26. The change of state of the sensing means actuates an electrical system (not shown but well within the competence of those skilled in the art) to trigger any form of alarm system and/or means commanding emergency halting of vehicles travelling on the track.

There is claimed:

1. A sensing system for use on a vehicle transportation system comprising at least one plate, support means for said plate adapted to hold said plate in a substantially horizontal position, sensor means for sensing depression of said plate and sensor actuating means for actuating said sensor means, said support means comprising a fixed support at a first edge of said plate and a moveable support at a second edge opposite said first edge thus permitting limited depression of said plate, said sensor means comprising a cable under the plate stretched taut between ends of the plate and in cooperative relationship with the plate, said sensor actuating means comprising a first actuating member fixed to the bottom surface of said plate and a second actuating member fixed to a support spaced beneath said plate and opposite to said first member, wherein said cable passes between said first and second actuating members and depression of said plate causes said first and second actuating members to act on and deform the cable disposed there between.

2. The sensing system of claim 1 comprising a plurality of like plates in side-by-side alignment.

3. The sensing system according to claim 1, wherein said first actuating member comprises a rib fixed to the bottom surface of the plate and said second actuating member comprises two spaced parallel ribs on said support adapted to receive said first actuating member rib fixed to said plate between them in response to depression of said plate together with said cable depressed by said rib fixed to said plate.

4. The sensing system according to claim 1, comprising a counterweighted lever adapted to tension said cable, one end of which is attached to a point on said lever intermediate its ends and the other end of which is attached to a fixed point whereby said lever is held in a predetermined position by said cable, and switch means cooperating with said lever.

5. The sensing system according to claim 1, wherein said support means comprises damper blocks of an elastomer material and spring supports, each plate is supported in part on said damper blocks, which are disposed in the vicinity of said first edge of each plate, and in part on said spring supports, which are disposed in the vicinity of said second edge of each plate opposite and parallel to said first edge.

6. A sensing system for use on a tracked vehicle transportation system, comprising a plurality of plates in side-by-side alignment, support means for said plates adapted to hold said plates in a substantially horizontal position, sensing means comprising at least one taut cable disposed beneath said plates and in cooperative relationship with said plates and actuating means between said plates and said sensing means, said actuating means comprising a first actuating member fixed to the bottom surface of each plate and a second actuating member fixed to a support spaced beneath each plate opposite to each first actuating member, said cable passes between said first and second actuating members, and each of said plates are displaceable and said sensing means is deformable in response to displacement of each of said plates.

7. The sensing system according to claim 6, wherein said first actuating member comprises a rib fixed to the bototm surface of said plate and said second actuating member comprises two spaced parallel ribs on said support adapted to receive said first actuating member rib fixed to the respective plate between them in response to depression of said plate, together with said cable depressed by said rib fixed to said plate.

8. The sensing system according to claim 7, wherein said ribs are substantially cylindrical metal members respectively fixed to said plates and said fixed support.

9. The sensing system according to claim 7, comprising a counterweighted lever adapted to tension said cable, one end of which is attached to a point on said lever intermediate its ends and the other end of which is attached to a fixed point whereby said lever is held in a predetermined position by said cable, and switch means cooperating with said lever.

10. The sensing system according to claim 6, wherein said support means comprises damper blocks of an elastomer material and spring supports, each of said plates is supported in part on said damper blocks, which are disposed in the vicinity of a first edge of each plate, and in part on said spring supports, which are disposed in the vicinity of a second edge of each plate opposite and parallel to said first edge.

11. The sensing system according to claim 10, wherein each of said spring supports comprises an axially movable stem, a pad at an upper end of said stem adapted to have the plate rest on its front surface, a shoulder on a rear surface of said pad and a spring adapted to bear on said shoulder to balance the weight of said plate.

12. A sensing system for use on a tracked vehicle transportation system comprising a plurality of plates in side by side alignment, support means for said plates adapted to hold said plates in a substantially horizontal position, thus defining a floor, sensing means disposed in cooperative relationship with said plates to be responsive to displacement of each of said plates, said sensing means comprising a taut cable connected to a switch means, said taut cable being disposed beneath said plates and actuating means provided between each plate and said cable, said actuating means comprises a first actuating member fixed to the bottom surface of each of said plates and a second actuating member fixed to a support spaced beneath each of said plates opposite to said first actuating member, wherein said cable passes between said first and second actuating members, and said actuating menas deform said cable on displacement of each of said plates and activate said switch means.

* * * * *